US008865635B1

(12) United States Patent
Nechyporenko

(10) Patent No.: US 8,865,635 B1
(45) Date of Patent: Oct. 21, 2014

(54) AQUEOUS-BASED CLEANING COMPOSITION WITH A WATER-INSOLUBLE, FATTY ALCOHOL-BASED BUILDER

(71) Applicant: S.C. Johnson & Son, Inc., Racine, WI (US)

(72) Inventor: Vasyl A. Nechyporenko, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/859,279

(22) Filed: Apr. 9, 2013

(51) Int. Cl.
*C11D 3/22* (2006.01)
*C11D 3/44* (2006.01)
*C11D 17/00* (2006.01)

(52) U.S. Cl.
CPC ..... *C11D 17/0017* (2013.01)
USPC ..... 510/182; 510/180; 510/181; 510/191; 510/199; 510/235; 510/238; 510/432; 510/470

(58) Field of Classification Search
USPC ..... 510/180, 181, 182, 191, 199, 235, 238, 510/432, 470
See application file for complete search history.

(56) References Cited

U.S. PATENT DOCUMENTS

| | | | | |
|---|---|---|---|---|
| 3,547,854 | A | 12/1970 | Roth et al. | |
| 3,679,609 | A | 7/1972 | Castner | |
| 4,315,828 | A | 2/1982 | Church | |
| 4,627,931 | A | 12/1986 | Malik | |
| 4,983,317 | A | 1/1991 | Requejo et al. | |
| 5,252,245 | A | 10/1993 | Garabedian, Jr. et al. | |
| 5,356,479 | A | 10/1994 | Menke et al. | |
| 5,399,282 | A | 3/1995 | Hansen et al. | |
| 5,437,807 | A | 8/1995 | Garabedian, Jr. et al. | |
| 5,468,423 | A | 11/1995 | Garabedian, Jr. et al. | |
| 5,500,154 | A | 3/1996 | Bacon et al. | |
| 5,536,451 | A | 7/1996 | Masters et al. | |
| 5,540,864 | A | 7/1996 | Michael | |
| 5,780,404 | A | 7/1998 | Bacon et al. | |
| 5,837,065 | A | 11/1998 | Haley et al. | |
| 5,849,681 | A | 12/1998 | Neumiller et al. | |
| 5,922,665 | A | 7/1999 | Liu | |
| 5,952,287 | A | 9/1999 | Gross et al. | |
| 5,990,072 | A | 11/1999 | Gross et al. | |
| 5,997,654 | A | 12/1999 | Murch et al. | |
| 6,194,362 | B1 | 2/2001 | Trinh et al. | |
| 6,224,685 | B1 | 5/2001 | Gross et al. | |
| 6,277,800 | B1 | 8/2001 | Galloway | |
| 6,302,969 | B2 | 10/2001 | Moster et al. | |
| 6,367,488 | B1 | 4/2002 | Murch et al. | |
| 6,380,151 | B1 | 4/2002 | Masters et al. | |
| 6,399,553 | B1 | 6/2002 | Cable et al. | |
| 6,420,326 | B1 | 7/2002 | Maile et al. | |
| 6,432,897 | B1 | 8/2002 | Cable | |
| 6,491,728 | B2 | 12/2002 | Bacon et al. | |
| 6,583,104 | B1 | 6/2003 | Christensen et al. | |
| 6,642,197 | B1 * | 11/2003 | Cheung et al. | 510/407 |
| 6,716,805 | B1 | 4/2004 | Sherry et al. | |
| 6,831,050 | B2 | 12/2004 | Murch et al. | |
| 6,881,711 | B1 | 4/2005 | Gershun et al. | |
| 6,936,579 | B2 | 8/2005 | Urban | |
| 6,936,580 | B2 | 8/2005 | Sherry et al. | |
| 7,082,951 | B2 | 8/2006 | Barnabas et al. | |
| 7,094,741 | B2 | 8/2006 | Barnabas et al. | |
| 7,396,808 | B1 | 7/2008 | Hood et al. | |
| 7,417,000 | B2 | 8/2008 | Barnabas et al. | |
| 7,465,700 | B1 | 12/2008 | Ochomogo et al. | |
| 7,521,413 | B2 | 4/2009 | Ochomogo et al. | |
| 7,527,060 | B2 | 5/2009 | Hood et al. | |
| 7,592,301 | B2 | 9/2009 | Smith et al. | |
| 7,625,856 | B2 | 12/2009 | Burt et al. | |
| 7,666,826 | B2 | 2/2010 | Smith et al. | |
| 7,696,145 | B2 | 4/2010 | Kaaret | |
| 7,879,785 | B2 | 2/2011 | Smith et al. | |
| 7,879,786 | B1 | 2/2011 | Bai et al. | |
| 2002/0119902 | A1 | 8/2002 | Harrison et al. | |
| 2005/0113277 | A1 | 5/2005 | Sherry et al. | |
| 2009/0221464 | A1 | 9/2009 | Berna Tejero et al. | |
| 2009/0325842 | A1 | 12/2009 | DeDominicis | |
| 2010/0234269 | A1 | 9/2010 | Dreilinger et al. | |
| 2011/0098206 | A1 | 4/2011 | Lynch et al. | |
| 2011/0146709 | A1 | 6/2011 | Toussaint et al. | |
| 2013/0098384 | A1 * | 4/2013 | Uellner | 132/208 |

* cited by examiner

*Primary Examiner* — Charles Boyer

(57) ABSTRACT

An aqueous-based cleaning composition including a water-insoluble builder component and a method of providing both such builder component and such cleaning composition in the absence of heat to provide a cleaning composition which is phase stable at room temperature without loss of cleaning efficacy. The builder component is composed of a $C_{10}$-$C_{16}$ linear fatty monohydric alcohol, e.g., tetradecanol, and an alcohol carrier. The alcohol carrier is preferably a $C_1$-$C_4$ monohydric alcohol. An alkyl glucoside is preferably also included in the cleaning composition to enhance the provision of the composition as a clear solution, and to promote combination of hydrophobic and hydrophilic materials upon the mixing of components to provide the cleaning composition.

20 Claims, No Drawings

AQUEOUS-BASED CLEANING COMPOSITION WITH A WATER-INSOLUBLE, FATTY ALCOHOL-BASED BUILDER

FIELD OF INVENTION

Aqueous-based cleaning compositions are disclosed which contain a water-insoluble builder component. In making the composition, the builder component is provided as an intermediate component in the absence of heating and added to the other components of the composition in the absence of heat to provide a composition which is phase stable at room temperature.

BACKGROUND OF THE INVENTION

Water-insoluble builders generally have been previously known per se, but have not been considered a choice as a builder for conventional cleaning formulas since they are not water-soluble and, therefore, are required to be heated in order to bring the builder into solution in an aqueous-based cleaning composition. Heating presents problems in making a cleaning composition. Heating adds cost to the manufacturing process, as well as detrimentally affects certain conventional components of cleaning compositions, for example, ammonia and fragrances.

SUMMARY OF INVENTION

The aqueous-based cleaning compositions disclosed herein, and the method of making such compositions, include the provision in the composition of a water-insoluble builder component in the absence of the use of heat, either in obtaining the builder component as an intermediate for use in the cleaning composition, or in the admixture of the intermediate builder component with the other components of the aqueous-based cleaning composition.

The water-insoluble builder component is composed of a $C_{10}$-$C_{16}$ linear fatty monohydric alcohol in combination with a $C_1$ to $C_4$ monohydric alcohol as a carrier. A preferred linear fatty monohydric alcohol is tetradecanol ($C_{14}$). The preferred carrier alcohols are methanol, ethanol and isopropanol.

In providing the intermediate builder component, the linear fatty monohydric alcohol is present in an amount of from about 0.05 to about 20 wt. % and the carrier alcohol is present in an amount of from about 80 to about 99.95 wt. %, wherein the intermediate builder component is based on 100 wt. %. A preferred range is from about 5 to about 15 wt. % of the linear fatty monohydric alcohol and from about 85 to about 95 wt. % carrier alcohol. The most preferred combination is 10 wt. % of the linear fatty monohydric alcohol, the preferred fatty alcohol being tetradecanol, and 90 wt. % carrier alcohol, the preferred carrier alcohol being ethanol.

The intermediate builder component is prepared without heating of the components upon combination to form the builder component. Further, upon addition of the resultant builder component with components to form a cleaning composition, no heat is used to bring the builder component into solution with the other components to provide the cleaning composition which contains water in a major proportion to the other included components, the cleaning composition being based on 100 wt. %.

The aqueous-based cleaning composition includes water, the builder component including a linear fatty monohydric alcohol and carrier alcohol, at least one surfactant, at least one non-water co-solvent, at least one pH adjuster to provide a pH in a range of 2-13, and optionally adjuvants such as one or more of a fragrance, dye, antibacterial, antimicrobial, chelating agent, and organic or inorganic acid. The cleaning composition is phase stable at room temperature (20°-25° C./68°-77° F.) and provides the appearance of a single homogenous phase.

As to the surfactant included in the cleaning composition, the nonionic surfactants $C_6$-$C_{10}$ alkyl glucosides have been found to in particularly improve in the manufacture of the composition the obtaining of a clear solution and the facilitation of the combination of hydrophobic and hydrophilic materials. A preferred glucoside is hexyl glucoside.

At least one additional surfactant is present in the cleaning composition besides the nonionic glucoside surfactant. The additional surfactant(s) can be one or more anionic, nonionic, cationic or amphoteric (including zwitterionic) surfactant. The cleaning composition of the disclosure can be used for cleaning various surfaces, preferably hard surfaces such as present in a household, for example kitchen and bathroom surfaces, including glass, porcelain, ceramic, metal, plastic, wood, etc. For surfaces where streaking is a consideration, such as glass and mirrors, the surfactants of choice are anionic and nonionic, with cationic and amphoteric being excluded since they are detrimental to obtaining a streak-free surface.

The intermediate builder component and aqueous-based cleaning compositions including the intermediate builder component are described in more detail below.

DETAILED DESCRIPTION OF THE INVENTION

The aqueous-based cleaning composition is useful for cleaning various porous and/or non-porous surfaces, especially household surfaces, such as found for example in the kitchen and bathroom. The surfaces can be of various hard materials, such as glass, mirrors, ceramic, porcelain, metal, wood, plastic, polymer, stone, and the like, as well as combinations thereof. The surfaces may be of any size, shape or orientation. The cleaning compositions can include various components depending on whether the composition is targeted for a particular use, e.g. to clean windows, or is to be used for multiple types of surfaces. Based on the use, variations in certain components may result. In preparing such cleaning compositions, the inclusion of a builder is beneficial to increase the effectiveness of the detergent(s) present and act as a sequestering agent and buffering agent. Builders suitable for inclusion in an aqueous-based cleaning composition, however, have been essentially limited to water-soluble builders. Water-insoluble builders have not been a realistic option since to place the water-insoluble builder into solution, heating of the components during manufacture of the cleaning composition is required. This increases the cost of manufacture as well as acts as a detriment to certain components conventional for inclusion in aqueous-based hard surface cleaning composition, e.g. fragrances and ammonia. Thus, the inclusion of water-insoluble builders has in the past been undesirable.

The aqueous-based cleaning composition of the disclosure, however, includes a water-insoluble builder component which does not require heat in either of the preparation of the intermediate builder component or of the intermediate builder component with the other components of the cleaning composition.

The intermediate builder component is based on the combination of a linear fatty monohydric alcohol and a carrier. The linear fatty monohydric alcohol is a $C_{10}$-$C_{16}$ linear monohydric alcohol (hereafter "fatty alcohol"). A preferred fatty alcohol is tetradecanol ($C_{14}$). The carrier is a $C_1$ to $C_4$ monohydric alcohol, for example, methanol, ethanol and isopropanol. Based on the intermediate builder being 100 wt. %, the fatty alcohol is combined in a amount of from about 0.05 to about 20 wt. % with the carrier alcohol which is present in an amount of from about 80 to about 99.95 wt. %. Preferably, the fatty alcohol is present in an amount of about 5 to about 15 wt. %, and the carrier is present in an amount of from about 85 to about 95 wt. %; most preferably from about 8 to about 12 wt. % fatty alcohol and from about 88 to about 92 wt. % of the carrier. The combination of the fatty alcohol with the carrier alcohol is accomplished at room temperature, i.e., ambient atmosphere at 20°-25° C. (68°-77° F.), through simple stirring or agitation to provide the intermediate builder component suitable for inclusion in an aqueous-based cleaning composition. The intermediate builder component is combined with other components making up the cleaning composition through simple stirring or agitation by which the builder component is brought into solution. The resulting cleaning composition is phase stable at room temperature, i.e., a homogenous solution without phase separation at room temperature. Based on the components of the cleaning composition totaling 100 wt. %, the intermediate builder component is present in the cleaning composition in an amount of from about 0.001 to about 0.5 wt. %, preferably about 0.0015 to about 0.005 wt. %.

Further benefit can be provided to the aqueous-based cleaning composition by including as a component thereof a $C_6$ to $C_{10}$ alkyl glucoside (a nonionic surfactant), preferably hexyl glucoside. The alkyl glucoside is instrumental in obtaining the cleaning product as a clear solution by promoting combination of hydrophobic and hydrophilic materials present as components of the cleaning composition. The glucoside component is present in the aqueous-based cleaning composition in an amount of from about 0.001 to about 5 wt. %, preferably about 0.0015 to about 0.005 wt. %.

Other components for inclusion in the aqueous-based cleaning composition include surfactant(s), non-water co-solvent(s), pH adjuster(s) and adjuvant(s) such as fragrances, dyes, antibacterials or antimicrobials, chelating agents, organic or inorganic acids; and other components as conventionally known for inclusion in an aqueous-based hard surface cleaning composition.

As to surfactants, the cleaning composition contains at least one additional surfactant aside from the alkyl glucoside nonionic surfactant. The at least one additional surfactant can be anionic, nonionic, cationic or amphoteric (including zwitterionic). When the cleaning composition, however, is to be used as a cleaner for a surface wherein streaking is undesirable, e.g. a glass cleaner, the at least one additional surfactant is to be limited to anionic and/or nonionic surfactants since cationic and amphoteric surfactants can be detrimental to obtaining a streak-free surface following cleaning with a composition containing cationic and amphoteric surfactants. The at least one additional surfactant is present in an amount of from about 0.05 to about 10 wt. %, preferably about 0.06 to about 5 wt. %.

The at least one additional surfactant can be selected from those conventionally known in the art for use in an aqueous-based hard surface cleaning composition. Examples of preferred surfactants which have been found to provide expected or better cleaning efficacy as to soil removal are set forth below.

An exemplary anionic surfactant suitable for use is an alkali metal salt of a secondary alkane sulphonate. A preferred secondary alkane sulphonate salt is the alkali metal $C_{14-17}$ sec-alkyl sulphonate, having a formula of $CH_3(CH_2)_mCH(SO_3^-Na^+)(CH_2)_n—CH_3$, wherein m+n=10-14, such as sold under the tradename HOSTAPUR SAS 30 as sold by Clariant GmbH, Germany. Other anionic surfactants suitable for use include alkali metal salts of alkyl, alkenyl, alkylaryl sulphonates and sulfates; alkali metal $C_{6-18}$ alkyl ether sulfates, e.g., sodium lauryl ether sulfate; and α-olefin sulfonates. Some such anionic surfactants have a general formula $RSO_4M$ or $RSO_3M$ where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g., ammonium, sodium, potassium or lithium).

The nonionic surfactant can be any nonionic surfactant as conventionally known for use in a hard surface cleaning composition. Preferred nonionic surfactants are primary or secondary mono-, di-, or poly-hydric alkoxylated alcohols, preferably alcohol ethoxylates including secondary alkanols condensed with $(OC_2H_4)$. Preferred alcohol ethoxylates are $C_8$-$C_{15}$ fatty alcohol ethoxylates. Other non-limiting examples of nonionic surfactants suitable for use include alkyl polyglycosides. Alkylpolyglycosides suitable for use have the formula: $RO—(R'O)_x—Z_n$ where R is a monovalent alkyl radical containing 8 to 20 carbon atoms (the alkyl group may be straight or branched, saturated or unsaturated), O is an oxygen atom, R' is a divalent alkyl radical containing 2 to 4 carbon atoms, preferably ethylene or propylene, x is a number having an average value of 0 to 12, Z is a reducing saccharide moiety containing 5 or 6 carbon atoms, preferably a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647, which are incorporated herein by reference. Some exemplary alkyl polyglycosides are sold under the name GLUCOPON and are as follows (where Z is a glucose moiety and x=0):

Exemplary GLUCOPONS

| Product | N | R (# carbon atoms) |
|---|---|---|
| 425N | 2.5 | 8-14 |
| 425LF | 2.5 | 8-14 (10 w/w % star-shaped alcohol added) |
| 220UP | 2.5 | 8-10 |
| 225DK | 2.7 | 8-10 |
| 600UP | 2.4 | 12-14 |
| 215CSUP | 2.5 | 8-10 |

Amine oxides are also suitable for use as a nonionic surfactant.

Preferred cationic surfactants include quaternary amines, e.g., alkali metal quaternary ammonium halides.

Preferred amphoteric surfactants include betaines, sulfobetaines, and amphocarboxylates.

The surfactants may be used alone or in mixtures. The preferred surfactant combination is of anionic and nonionic surfactants.

The non-water co-solvent component is composed of at least one co-solvent present in an amount of from about 0.8 to about 10 wt. %, preferably about 0.8 to about 4 wt. %. Preferred co-solvents include $C_1$ to $C_6$ monohydric alcohols (such as, for example, methanol, ethanol and/or isopropanol), $C_1$ to $C_6$ diols, alkylene glycols (such as, for example, propylene glycol and ethylene glycol), $C_3$ to $C_{24}$ alkylene glycol ethers (such as, for example, ethylene glycol ether and propylene glycol ether).

The pH adjuster(s) are included in an amount sufficient to provide a desired pH in the range of 2 to 13. In an alkaline composition, the pH is preferably in a range of 10-13 for a multi-surface/purpose cleaning composition; in a range of 10-11.5 for a kitchen surface cleaner; and in a range of 10-11 for a glass cleaning composition.

Preferred pH adjusters are alkali metal hydroxides, such as sodium hydroxide and potassium hydroxide; ammonium hydroxide; ammonia; alkanolamines; alkali metal carbonates; alkali metal bicarbonates; organic or inorganic acids or mixtures thereof, for example acetic acid, lactic acid, citric acid, sulphamic acid, oxalic acid, hydrochloric acid, and sulfuric acid; or chelating agents such as sodium ethylenediamine tetraacetic acid (EDTA), borax, or sodium nitrilotriacetic acid (NTA).

The pH adjusters are present in a total amount based on one or more pH adjusters being present of from about 0.1 to about 5 wt. %, preferably from about 0.3 to about 1 wt. %.

Adjuvants to enhance aesthetic characteristics or to provide a further or enhanced function to the cleaning composition may optionally also be included. Suitable adjuvants for inclusion include, in preferred amounts, fragrance(s) in an amount of from about 0.01 to about 1.0 wt. %; dye(s) in an amount of from about 0.0001 to about 1 wt. %; antibacterial and/or antimicrobial agents in an amount of from about 0.001 to about 5 wt. %; a supplemental cleaning agent or degreaser such as sodium metasilicate or gluconic acid in an amount from about 0.1 to about 10 wt. %; and other adjuvants as conventionally known for inclusion in an aqueous-based hard surface cleaning composition may be included. "Fragrance" as used herein refers to any perfume, odor-eliminator, odor masking agent, the like and combinations thereof, natural or synthetic. A further useful adjuvant if the composition is stored and/or dispensed from a metal container is a corrosion inhibiter, such as an alkali metal nitrite, benzoate, borate, carbonate, bicarbonate or silicate.

The balance of the cleaning composition to 100 wt. % is water. The water can be soft water, deionized water, reversed osmosis water, tap water, or the like.

EXAMPLES

Set forth below are examples of compositions of the present invention. The "wt. %" is based on the components of the total composition being selected to equal 100 wt. %.

(1) Glass Cleaner

| Ingredients | Wt. % |
|---|---|
| Water | 98.0-99.0 |
| Anionic Surfactant | 0.2-0.3 |
| Alkylene Glycol Ether | 0.4-0.5 |
| $C_1$-$C_4$ Monohydric Alcohol | 0.3-0.4 |
| pH Adjuster | 0.3-0.4 |
| Fragrance | 0.02-0.05 |
| Dye | 0.003-0.0075 |
| Intermediate Builder Component | 0.001-0.05 |
| Alkyl Glucoside | 0.01-0.1 |
| Supplemental pH adjuster/saponification agent | 0.001-0.1 |

(2) Glass Cleaner

| Ingredients | Wt. % |
|---|---|
| Soft Water | 98.297 |
| Sodium Dodecyl Benzene Sulfonate (40% active) | 0.2 (0.08 active) |
| Ethylene Glycol N-Hexyl Ether | 0.6 |
| Denatured Ethanol | 0.3 |
| Ammonium Hydroxide | 0.5 |
| Fragrance | 0.03 |
| Dye | 0.003 |
| Tetradecanol (10%) and Ethanol (90%) | 0.025 (0.0025 active tetradecanol) (0.0225 active ethanol) |
| Hexyl Glucoside(75%active) | 0.045 (0.03375 active) |
| pH = 10.2-10.7 | |

(3) Glass Cleaner

| Ingredients | Wt. % |
|---|---|
| Soft Water | 98.4026 |
| Sodium $C_{14-17}$ Sec-Alkyl Sulphonate (30%) | 0.4 (0.12 active) |
| Ethylene Glycol N-Hexyl Ether | 0.5 |
| Ethanol | 0.3 |
| Ammonium Hydroxide | 0.3 |
| Fragrance | 0.03 |
| Dye | 0.0074 |
| Hexyl Glucoside (75% active) | 0.035 (0.02625 active) |
| Tetradecanol (10%) and Ethanol (90%) | 0.025 (0.0025 active tetradecanol) (0.0275 active ethanol) |

(4) Glass Cleaner

| Ingredients | Wt. % |
|---|---|
| Soft Water | 98.684 |
| Sodium $C_{14-17}$ Sec-Alkyl Sulphonate (30%) | 0.4 (0.12 active)) |
| Hexyl Glucoside (75% active) | 0.035 (0.02625 active) |
| Ethylene Glycol N-Hexyl Ether | 0.5 |
| Ethanol | 0.3 |
| Caustic Soda (50% active) | 0.025 (0.0125 active) |
| Fragrance | 0.03 |
| Dye #1 | 0.00025 |
| Dye #2 | 0.00075 |
| Tetradecanol (10%) and Ethanol (90%) | 0.025 (0.0025 active tetradecanol) (0.0275 active ethanol) |

(5) Glass Cleaner

| Ingredients | Wt. % |
|---|---|
| Soft Water | 98.625 |
| Sodium $C_{14-17}$ Sec-Alkyl Sulphonate (30%) | 0.4 (0.12 active) |
| Hexyl Glucoside (75% active) | 0.035 (0.02625 active) |
| Ethylene Glycol N-Hexyl Ether | 0.5 |
| Ethanol | 0.3 |
| Acetic Acid (80% active) | 0.03 (0.8003 active) |
| Caustic Soda (50% active) | 0.045 (0.0225 active) |
| Fragrance | 0.03 |
| Dye #1 | 0.0037 |
| Dye #2 | 0.0063 |
| Tetradecanol (10%) and Ethanol (90%) | 0.025 (0.0025 active tetradecanol) (0.0275 active ethanol) |

| (6) Kitchen Cleaner | |
|---|---|
| Ingredients | Wt. % |
| Deionized Water | 92.842 |
| Diethylene Glycol Butyl Ether | 2.0 |
| Sodium Metasilicate | 1.0 |
| $C_{12-15}$ Ethoxylated Alcohol (9EO) | 0.5 |
| Ethylene Glycol Phenyl Ether | 2.0 |
| Hexyl Glucoside | 0.2 |
| Fragrance | 0.1 |
| N-Alkyl Dimethyl Benzyl Ammonium Chloride | 0.25 |
| Tetradecanol (10%) and Ethanol (90%) | 0.025 (0.0025 active tetradecanol) (0.0275 active ethanol) |

The soil removal and non-streaking properties of the aqueous-based cleaning composition with the intermediate builder component and alkyl glucoside were maintained or comparable in relation to certain commercially available hard surface/glass cleaners when the builder component and composition were made in the absence of heating in the manufacturing process.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A method of making an aqueous-based cleaning composition containing a water-insoluble builder comprising;

(a) in a first step, combining at room temperature a C10 to C16 linear fatty monohydric alcohol in an amount of about 0.05 to about 20 wt. % with a $C_1$ to $C_4$ monohydric alcohol present in an amount of about 80 to about 99.95 wt. % to provide a builder component based on 100 wt. %;

(b) in a subsequent step, combining said builder component at room temperature with 1) a $C_6$ to $C_{10}$ alkyl glucoside surfactant, 2) at least one additional surfactant selected from the group consisting of anionic, nonionic, cationic, amphoteric, and zwitterionic surfactants or mixtures thereof;

3) water;

4) at least one non-water co-solvent different from the solvents in step (a);

5) at least one pH adjuster to provide a pH in a range of 2-13; and 6) optionally, one or more adjuvants selected from the group consisting of fragrances, dyes, antibacterials and antimicrobials;

wherein the composition provided is phase stable at room temperature.

2. The method of claim 1, wherein said linear fatty monohydric alcohol is tetradecanol.

3. The method of claim 1, wherein said $C_1$ to $C_4$ monohydric alcohol is methanol, ethanol or isopropanol.

4. The method of claim 1, wherein said alkyl glucoside is hexyl glucoside.

5. The method of claim 1, wherein said at least one non-water co-solvent is selected from the group consisting of $C_{1-3}$ monohydric alcohols, alkylene glycols and alkylene glycol ethers.

6. The method of claim 1, wherein said at least one additional surfactant is one or more of an anionic surfactant and a nonionic surfactant.

7. The method of claim 6, wherein said anionic surfactant is one or more of an alkali metal alkyl sulfate and sulphonate; and the nonionic surfactant is one or more of a $C_8$-$C_{15}$ fatty alcohol ethoxylate and alkyl polyglucoside.

8. The method of claim 1, wherein said at least one pH adjuster is selected from an alkali metal hydroxide or ammonium hydroxide, and an organic or inorganic acid.

9. The method of claim 1, wherein said pH is in a range of 10-13.

10. The method of claim 1, wherein, based on said composition being 100 wt. %, said builder component is combined in an amount of from about 0.001 to about 0.5 wt. %; said alkyl glucoside is present in an amount from about 0.001 to about 5 wt. %; said at least one surfactant is present in an amount of from about 0.05 to about 10 wt. %; said at least one non-water co-solvent is present in an amount of from about 0.8 to about 10 wt. %; and said water is present in an amount to provide a balance to 100 wt. %.

11. An aqueous based cleaning composition prepared by the method of present claim 1.

12. The composition of claim 11, wherein said linear fatty monohydric alcohol is tetradecanol.

13. The composition of claim 11, wherein said $C_1$ to $C_4$ monohydric alcohol is methanol, ethanol or isopropanol.

14. The composition of claim 11, wherein said alkyl glucoside is hexyl glucoside.

15. The composition of claim 11, wherein said at least one non-water co-solvent is selected from the group consisting of $C_{1-3}$ monohydric alcohol, alkylene glycols and alkylene glycol ethers.

16. The composition of claim 11, wherein said at least one additional surfactant is one or more of an anionic surfactant and a nonionic surfactant.

17. The composition of claim 16, wherein said anionic surfactant is one or more of an alkali metal alkyl sulfate or sulphonate; and said nonionic surfactant is one or more of a $C_8$-$C_{15}$ fatty alcohol ethoxylate and alkyl polyglucoside.

18. The composition according to claim 11, wherein said at least one pH adjuster is selected from an alkali metal hydroxide or ammonium hydroxide, and an organic or inorganic acid.

19. The composition of claim 11, wherein the pH is in a range of 10-13.

20. The composition of claim 11, wherein, based on said composition being 100 wt. %, said builder component is present in an amount of from about 0.001 to about 0.5 wt. %; said alkyl glucoside is present in an amount of from about 0.001 to about 5 wt. %; said at least one additional surfactant is present in an amount of from about 0.05 to about 10 wt. %; said at least one non-water co-solvent is present in an amount of from about 0.8 to about 10 wt. %; and said water is present in an amount to provide a balance to 100 wt. %.

* * * * *